US010476205B2

(12) United States Patent
Chung

(10) Patent No.: US 10,476,205 B2
(45) Date of Patent: Nov. 12, 2019

(54) PLUG WITH POSITIONING CAP

(71) Applicant: TC & C ELECTRONIC CO., LTD., Taoyuan (TW)

(72) Inventor: Li Hua Chung, Taoyuan (TW)

(73) Assignee: TC & C Electronic Co., Ltd., Taoyuan (TW)

( * ) Notice: Subject to any disclaimer, the term of this patent is extended or adjusted under 35 U.S.C. 154(b) by 0 days.

(21) Appl. No.: 16/003,972

(22) Filed: Jun. 8, 2018

(65) Prior Publication Data

US 2019/0305481 A1 Oct. 3, 2019

(30) Foreign Application Priority Data

Apr. 3, 2018 (TW) ..... 107111833 A

(51) Int. Cl.

| | |
|---|---|
| ***H01R 12/71*** | (2011.01) |
| ***H01R 13/631*** | (2006.01) |
| ***H01R 13/506*** | (2006.01) |
| *H01R 13/405* | (2006.01) |
| *H01R 13/26* | (2006.01) |

(52) U.S. Cl.
CPC ..... *H01R 13/631* (2013.01); *H01R 13/506* (2013.01); *H01R 12/716* (2013.01); *H01R 13/26* (2013.01); *H01R 13/405* (2013.01)

(58) Field of Classification Search
CPC .... H01R 13/629; H01R 12/716; H01R 24/60; H01R 24/62; H05K 5/0069
See application file for complete search history.

(56) References Cited

U.S. PATENT DOCUMENTS

| | | | | |
|---|---|---|---|---|
| 8,979,594 | B2 * | 3/2015 | Tsai | H01R 13/6658 439/660 |
| 9,472,911 | B2 * | 10/2016 | Little | H01R 24/60 |
| 10,141,696 | B2 * | 11/2018 | Tsai | H01R 24/60 |

* cited by examiner

*Primary Examiner* — Vanessa Girardi
(74) *Attorney, Agent, or Firm* — Wang Law Firm, Inc.

(57) ABSTRACT

A plug, which is adapted to engage a receptacle on a circuit board, includes a housing, and a pin module received in the housing to form a gap between an inner side of the housing and an outer surface of the pin module. A wall of the receptacle is received in the gap, and the housing covers the wall of the receptacle when the plug engages the receptacle to have a firm connection between the plug and the receptacle.

6 Claims, 6 Drawing Sheets

PLUG WITH POSITIONING CAP

BACKGROUND OF THE INVENTION

1. Technical Field

The invention relates to an electrical connector, and more particularly to a plug with a positioning cap.

2. Description of Related Art

In present days, the requirements of power for portable electronic devices are increasing. In order to achieve the requirement, there are some USB connectors having wide pins. Such connector usually has a wide grounding terminal and a wide power terminal to satisfy large current and avoid noise. In particular, the plug and the motherboard are 20 pins.

A conventional electrical plug has a case and a pin module (with conductive pins) extending out of the case. In operation, the pin module is inserted into a slot of a receptacle, and the case is left out of the receptacle. There is no positioning structure between the plug and the receptacle except the connecting pin engaging the slot, so that the plug may be disengaged with the receptacle with an external force.

BRIEF SUMMARY OF THE INVENTION

In view of the above, the primary objective of the present invention is to provide a lamp module of a plug, which engages a receptacle in a firm status.

In order to achieve the objective of the present invention, a plug, which is adapted to engage a receptacle on a circuit board, includes a housing, and a pin module received in the housing to form a gap between an inner side of the housing and an outer surface of the pin module. Whereby a wall of the receptacle is received in the gap, and the housing covers the wall of the receptacle when the plug engages the receptacle.

In an embodiment, the pin module is connected to the housing by molding.

In an embodiment, the housing has a room. The pin module is totally received in the room, and the gap is formed between a sidewall of the room and the outer surface of the pin module.

In an embodiment, the housing has a first housing piece and a second housing piece. The pin module is connected to the first housing piece and has a distal portion extending out of the first housing piece via a front end thereof; the second housing piece is connected to the front end of the first housing piece to receive the distal portion of the pin module, so that the gap is formed between an inner side of the second housing piece and the outer surface of the pin module.

In an embodiment, the housing further includes a connecting device to connect the first housing piece to the second housing piece.

As a result, the plug and the receptacle will have a firm connection when the plug engages the receptacle.

BRIEF DESCRIPTION OF THE SEVERAL VIEWS OF THE DRAWINGS

The present invention will be best understood by referring to the following detailed description of some illustrative embodiments in conjunction with the accompanying drawings, in which.

DETAILED DESCRIPTION OF THE INVENTION

Figure 1:
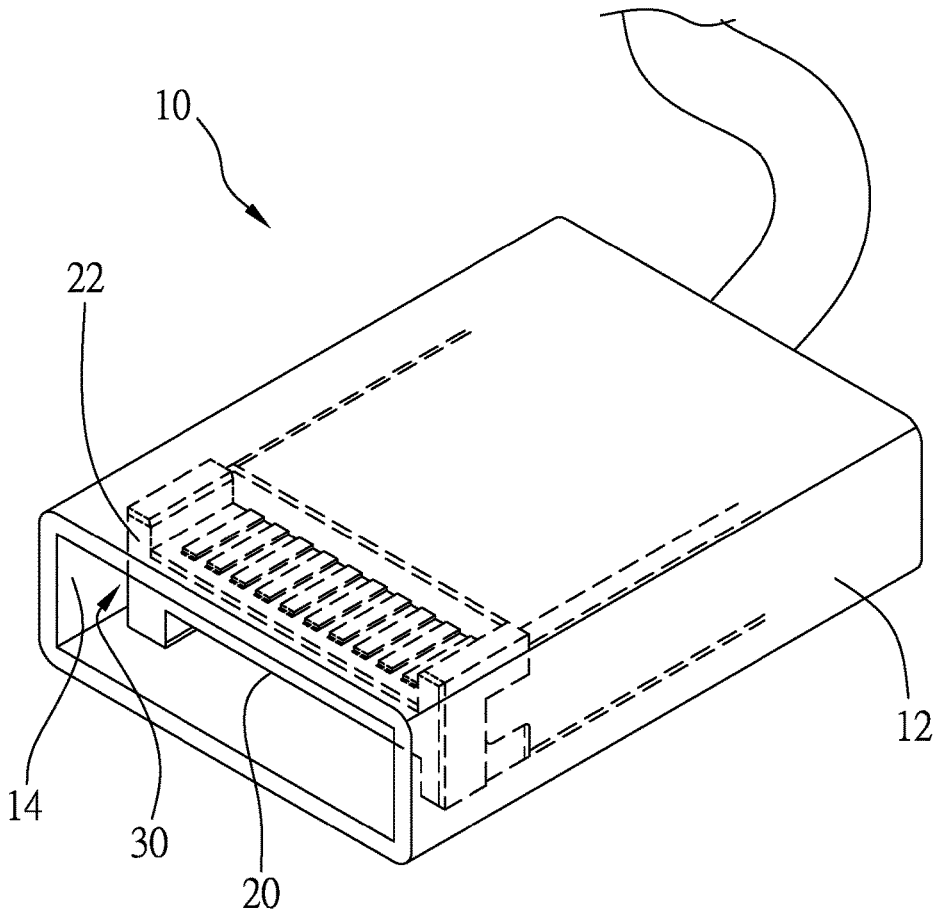
FIG. 1 is a perspective view of a first preferred embodiment of the present invention.
Figure 2:
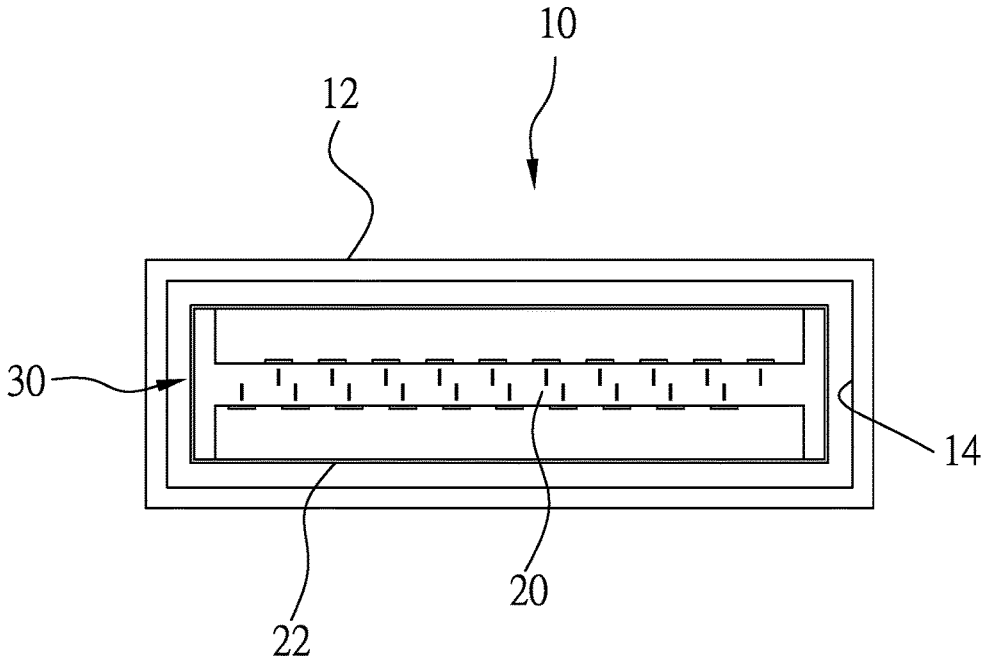
FIG. 2 is a front view of the first preferred embodiment of the present invention.

FIG. 1 and FIG. 2 show a plug 10 of the first preferred embodiment of the present invention, which includes a housing 12 and a pin module 20 in the housing 12. The pin module 20 has a plurality of conductive pins, and precisely, the plug 10 is a USB 20 PIN plug.

The housing 12 has an inner side 14, and the pin module 20 has an outer surface 22. There is a gap 30 between the inner side 14 of the housing 12 and the outer surface 22 of the pin module 20.

Figure 3:
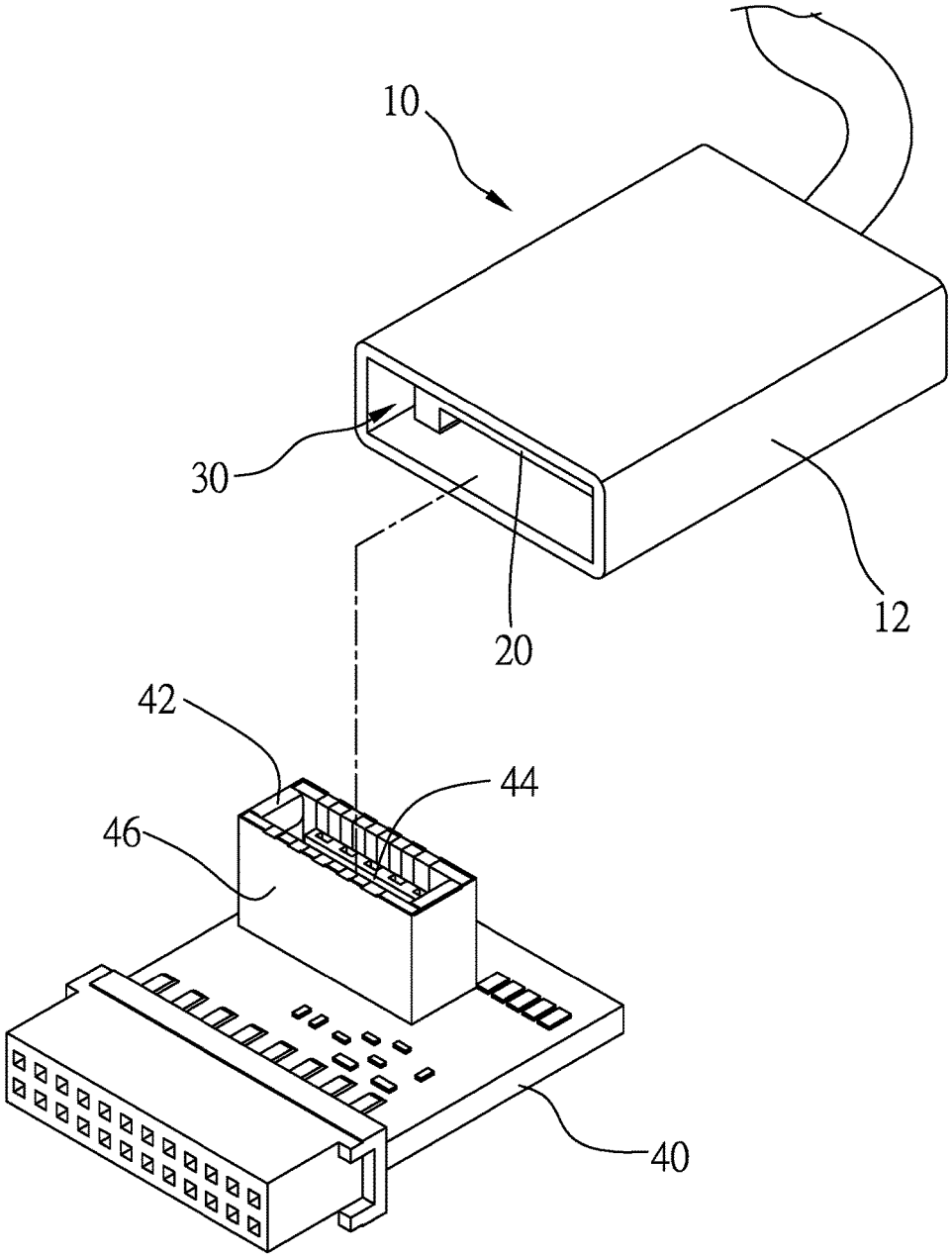
FIG. 3 is an exploded view of the preferred embodiment of the present invention, showing the plug and the receptacle.
Figure 4:
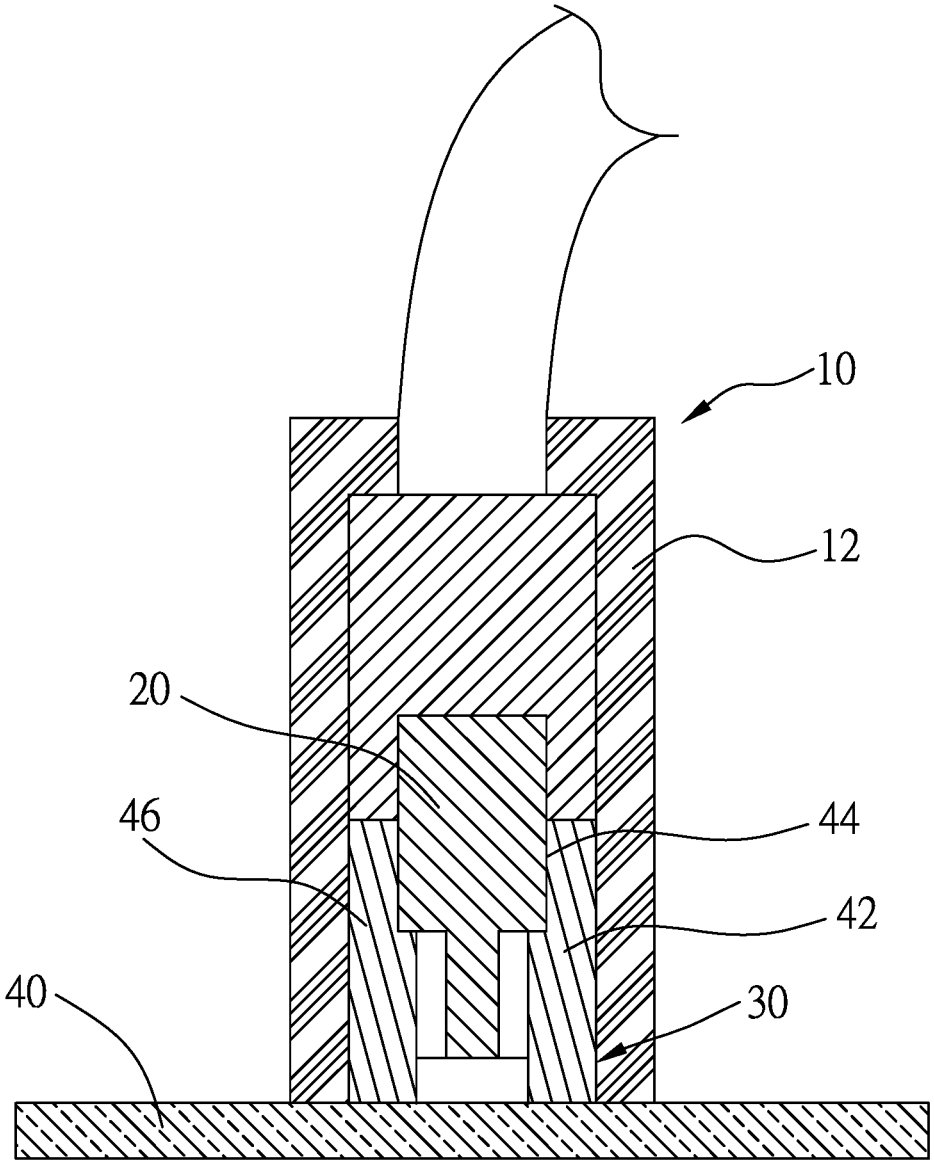
FIG. 4 is a sectional view of the preferred embodiment of the present invention, showing the plug engaging the receptacle.

As shown in FIG. 3 and FIG. 4, the plug 10 of the first preferred embodiment is adapted to engage a receptacle 42 on a circuit board 40. Precisely, the receptacle 42 has a slot 44, which is surrounded by a wall 46. The pin module 20 is received in the slot 44 and the wall 46 is received in the gap 30 when the plug 10 engages the receptacle 42. As a result, the housing 12 of the plug 10 covers entire (or a portion) of the wall 46 of the receptacle 42 to have a firm connection between the plug 10 and the receptacle 42. The plug 10 is not easy to be disengaged with the receptacle 42 by an external force.

The housing 12 is made of plastic, and the pin module 20 is made with the housing 12 by molding to form the gap 30 between the inner side 14 of the housing 12 and the outer surface 22 of the pin module 20. Besides, a distal end of the pin module 20 is received in the housing 12, in other words, the pin module 20 are totally received in the housing 12.

Figure 5:
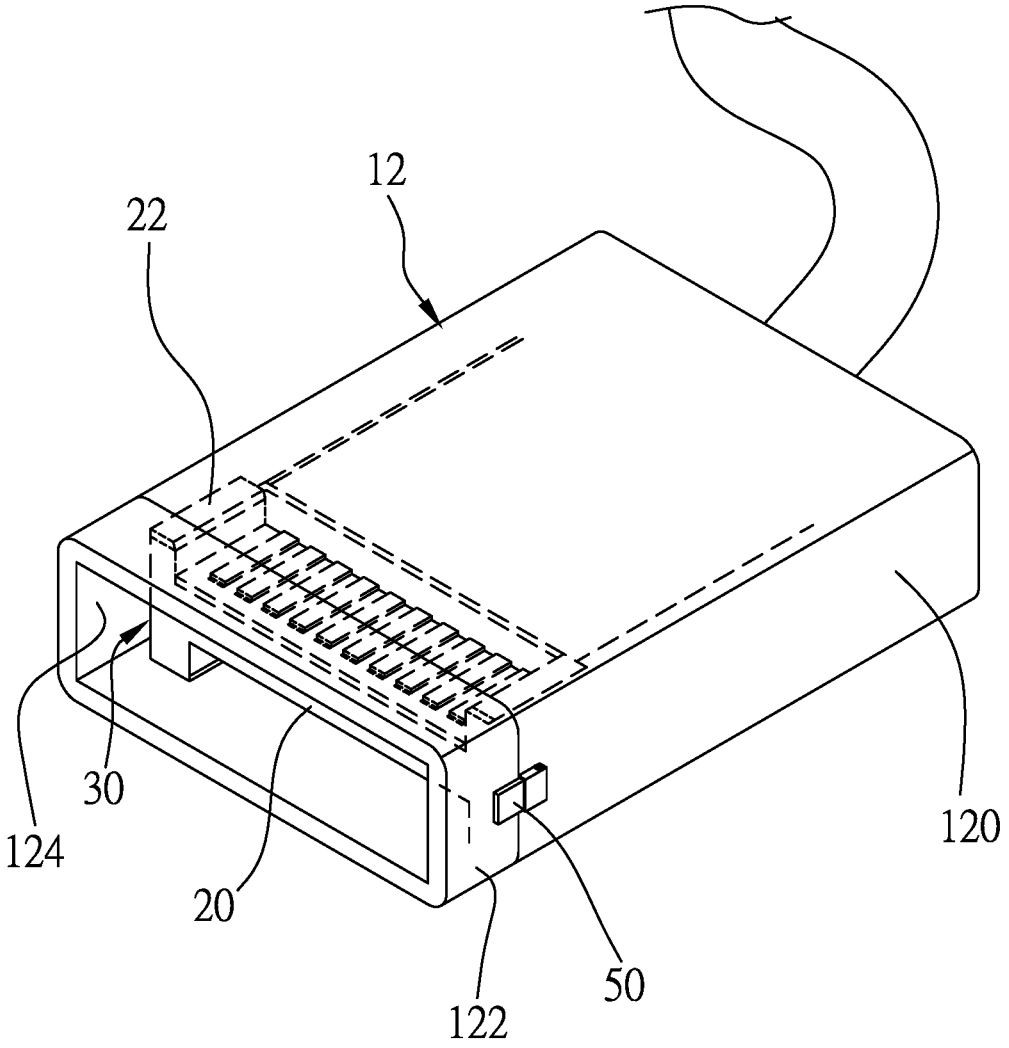
FIG. 5 a perspective view of a second preferred embodiment of the present invention.

As shown in FIG. 5, the second preferred embodiment of the present invention provides a housing 12 including a first housing piece 120 and a second housing piece 122. A pin module 20 is received and fixed in the first housing piece 120, and has a distal portion extending out of the first housing piece 120 via a front end thereof. The second housing piece 122 is connected to the front end of the first housing piece 120 to receive the distal portion of the pin module 20 therein, so that a gap 30 is formed between an inner side 124 of the second housing piece 122 and an outer surface 22 of the pin module 20.

A connecting device 50 is provided to connect the second housing piece 122 to the front end of the first housing piece 120. In the second preferred embodiment, the connecting device 50 is a buckle having a hook and a catch on the first and the second housing pieces 120, 122.

Figure 6:
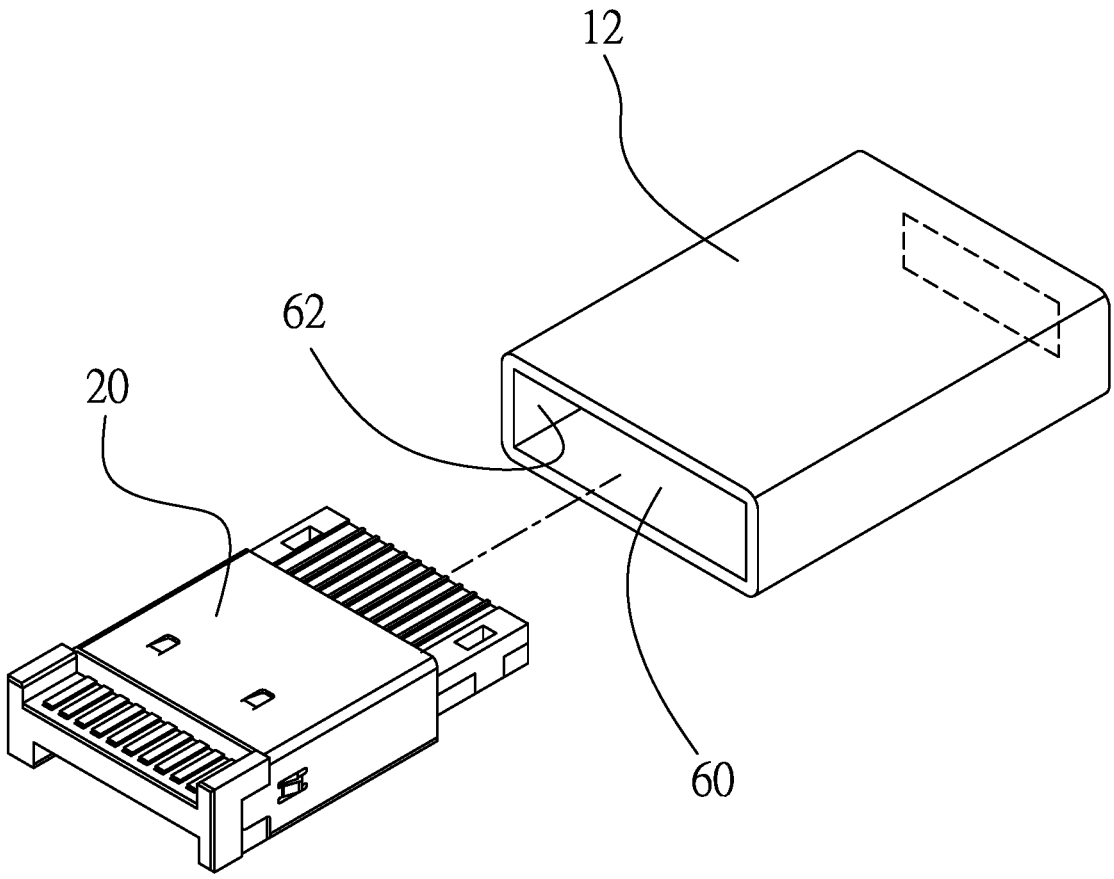
FIG. 6 is a sectional view of a third preferred embodiment of the present invention.

As shown in FIG. 6, the third preferred embodiment of the present invention provides a housing 12 having a room 60, in which a pin module 20 is received and fixed. A gap is formed between a sidewall 62 of the room 60 and an outer surface 22 of the pin module 20.

It must be pointed out that the embodiments described above are only some preferred embodiments of the present invention. All equivalent structures which employ the concepts disclosed in this specification and the appended claims should fall within the scope of the present invention.

What is claimed is:

1. A plug, which is adapted to engage a receptacle on a circuit board, comprising:

a housing; and a pin module received in the housing to form a gap between an inner side of the housing and an outer surface of the pin module;

whereby a wall of the receptacle is received in the gap, the pin module is inserted into the receptacle, and the housing has a portion surrounding an outer side of the wall of the receptacle when the plug engages the receptacle wherein the housing touches the circuit board to which the receptacle is connected when the plug engages the receptacle.

2. The plug of claim 1, wherein the pin module is connected to the housing by molding.

3. The plug of claim 1, wherein the housing has a room; the pin module is totally received in the room, and the gap is formed between a sidewall of the room and the outer surface of the pin module.

4. The plug of claim 1, wherein the wall of the receptacle is totally received in the housing of the plug when the plug engages the receptacle.

5. The plug of claim 1, wherein housing has a first housing piece and a second housing piece; the pin module is connected to the first housing piece and has a distal portion extending out of the first housing piece via a front end thereof; the second housing piece is connected to the front end of the first housing piece to receive the distal portion of the pin module, so that the gap is formed between an inner side of the second housing piece and the outer surface of the pin module.

6. The plug of claim 5, wherein the housing further includes a connecting device to connect the first housing piece to the second housing piece.

* * * * *